United States Patent [19]

Schilowitz et al.

[11] Patent Number: 4,964,880

[45] Date of Patent: Oct. 23, 1990

[54] DISTILLATE FUELS CONTAINING MONO ALKYL SUBSTITUTED DERIVATIVES OF THIADIAZOLES

[75] Inventors: Alan M. Schilowitz, Highland Park; Harold Shaub, Berkeley Heights; Paul J. Berlowitz, East Windsor; Howard S. Homan, Piscataway; Eric E. Wigg, Westfield, all of N.J.

[73] Assignee: Exxon Research & Engineering Company, Florham Park, N.J.

[21] Appl. No.: 364,741

[22] Filed: Jun. 9, 1989

[51] Int. Cl.[5] ..... C10L 1/22; C10L 1/24

[52] U.S. Cl. ..... 44/341

[58] Field of Search ..... 44/63, 57, 76, 70; 548/142

[56] References Cited

U.S. PATENT DOCUMENTS

| | | | |
|---|---|---|---|
| 4,255,589 | 3/1981 | Wisotsky | 252/42.7 |
| 4,301,019 | 11/1981 | Horodysky et al. | 252/47.5 |
| 4,761,482 | 8/1988 | Karol | 548/142 |
| 4,795,479 | 1/1989 | Karol | 44/63 |
| 4,828,574 | 5/1989 | Bertram | 44/63 |

*Primary Examiner*—Jacqueline V. Howard

*Attorney, Agent, or Firm*—John W. Ditsler

[57] ABSTRACT

Distillate fuel compositions containing mono alkyl substituted derivatives of thiadiazole are effective in reducing the formation of intake valve deposits in internal combustion engines. Mono alkyl substituted derivatives of 2,5-dimercapto-1,3,4-thiadiazole are preferred.

39 Claims, No Drawings

DISTILLATE FUELS CONTAINING MONO ALKYL SUBSTITUTED DERIVATIVES OF THIADIAZOLES

BACKGROUND OF THE INVENTION

1. Field of the Invention

This invention concerns a distillate fuel composition containing a mono alkyl substituted derivative of thiadiazole and its use to reduce the formation of intake valve deposits in an internal combustion engine.

2. Description of Related Art

Various substituted derivaties of thiadiazoles have been used to inhibit corrosion in lubricating oils. For example, U.S. Pat. No. 2,703,784 discloses a lubricating oil containing an oil soluble reaction product of an aldehyde, a mercaptan, and 2,5-dimercapto-1,3,4-thiadiazole.

U.S. Pat. No. 2,765,289 discloses a lubricating oil containing an oil soluble reaction product of an aldehyde, a diarylamine, and 2,5-dimercapto-1,3,4-thiadiozole.

U.S. Pat. No. 2,850,453 discloses a lubricating oil comprising an oil soluble reaction product obtained by reacting 2,5-dimercapto-1,3,4-thiadiazole, an aldehyde, and an organic hydroxy compound.

U.S. Pat. No. 2,719,126 discloses a lubricating oil containing an oil soluble polysulfide derivative of 2,5-dimercapto-1,3,4-thioadiazole.

U.S. Pat. No. 2,799,651 discloses a lubricating oil comprising an oil soluble derivative of 2-mercapto-4-phenyl-5-thione-1,3,4-thiadiazole.

U.S. Pat. No. 2,764,547 discloses a lubricating oil comprising an oil soluble reaction product of 2,5-dimercapto-1,3,4-thiadiazole and an unsaturated cyclic compound.

U.S. Pat. No. 2,799,652 discloses a lubricating oil containing an oil soluble product obtained by reacting 2,5-dimercapto-1,3,4-thiadiazole with an unsaturated ketone.

In addition, several patents disclose the use of other substituted derivatives of thiadiazoles in lubricating oils and in fuels wherein the thiadiazoles contain di- or polysulfides. (See, for example, U.S. Pat. Nos. 2,719,126; 3,683,561; 4,104,179, and GB No. 1,474,048).

However, none of these patents suggest the particular classes of thiadiazole derivatives disclosed herein or their effectiveness in reducing the formation of intake valve deposits.

SUMMARY OF THE INVENTION

This invention concerns a distillate fuel composition containing a particular class of thiadiazole derivatives. More specifically, we have discovered that a distillate fuel containing a major amount of gasoline and a minor amount of a mono alkyl substituted thiadiazole derivative can reduce the formation of intake valve deposits in internal combustion engines. Mono alkyl substituted derivatives of 2,5-dimercapto-1,3,4-thiadiazole are preferred. Mixtures of these compounds with a low volatility carrier fluid are particularly preferred.

DETAILED DESCRIPTION OF THE INVENTION

The mono alkyl substituted thiadiazole derivatives of this invention are oil soluble and have the general structure

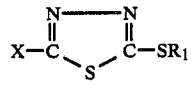

wherein $R_1$ is essentially a hydrocarbyl radical having a number average molecular weight of from about 350 to about 5,000, and X is OH, $NH_2$, SH, or H, with $NH_2$ or SH being preferred.

This general structure is also meant to include the tautometric forms of the mono alkyl substituted thiadiazole derivatives.

$R_1$ may have a variety of structures. For example, $R_1$ may be straight chained or branched. $R_1$ may also be aliphatic or alicyclic but, generally, will be free or substantially free of aromatic unsaturation. In addition, $R_1$ may contain a hydroxyl group (i.e. OH), such as might occur when $R_1$ is derived from an epoxide. Thus, as used herein, $R_1$ refers to essentially a hydrocarbyl radical. Preferably, however, $R_1$ should be a polymer of olefins having from 2 to 6 carbon atoms (if ethylene is used, the ethylene will be copolymerized with an olefin of at least 3 carbon atoms).

Typically $R_1$ should have a number average molecular weight between about 350 and about 5000, preferably between about 500 and about 1500. In general, there will be one mole of $R_1$ for each mole of thiadiazole. However, some disubstituted thiadiazole may be present. In addition, when X is OH or $NH_2$, substitution may also occur on the nitrogen or oxygen in X.

$R_1$ may be readily prepared by polymerizing olefins of from 2 to 6 carbon atoms (copolymerizing an olefin of from 3 to 6 carbon atoms with ethylene) and, preferably, by polymerizing olefins of from 3 to 4 carbon atoms. Therefore, $R_1$ is preferably based on polymer backbones of propylene, isobutylene, or mixtures thereof, with polyisobutylene being the most preferred polymer backbone.

Examples of mono alkyl substituted thiadiazole derivatives that can be used in this invention include 2-mercapto, 5-polyisobutenyl thio-1,3,4 thiadiazole; 2-amino, 5-polyisobutenyl thio-1,3,4 thiadiazole; 2-mercapto, 5-polypropenyl thio-1,3,4 thiadiazole; 2-amino, 5-polypropenyl thio-1,3,4 thiadiazole; or mixtures thereof, with 2-mercapto, 5-polyisobutenyl thio-1,3,4 thiadiazole being most preferred.

The distillate fuels of this invention will, in general, comprise a major amount of gasoline and a minor amount of the mono alkyl substituted thiadiazole derivatives described above. However, the precise amount of thiadiazole derivatives used can vary broadly. As such, only an amount effective or sufficient to reduce the formation of intake valve deposits need be used. Typically, however, the amount of thiadiazole derivative used will range from about 40 to about 1000 ppm, although greater amounts could be used. Preferably, from about 50 to about 500 ppm of the thiadiazole derivatives will be present in the fuel.

Some of the mono alkyl substituted thiadiazole derivatives are commercially available (e.g. the reaction product of epoxidized polyisobutylene and 2,5-dimercapto-1,3,4 thiadiazole). These derivatives can be prepared by reacting an epoxidized polyolefin (such as epoxidized polyisobutylene available from Amoco Chemical under the Actipol® trade name) with an equimolar amount (or small excess) of a substituted thiadiazole such as 2,5-dimercapto-1,3,4 thiadiazole. Typically, the epoxidized polyolefin is added to a mixture of the 2,5-dimercapto-1,3,4 thiadiazole dissolved in a suitable solvent (such as ethyl acetate). After stirring the total mixture for several hours at room temperature (or slightly higher), the solvent can be removed by various separation techniques (e.g. evaporation). Unreacted thiadiazole can then be isolated by redissolving the mixture in a suitable solvent (e.g. heptane) followed by filtration.

The mono alkyl substituted thiadiazole derivatives can also be prepared by using a chlorinated polyisobutylene intermediate. Synthesis of chlorinated polyisobutylene is well known in the art (see, for example, U.S. Pat. No. 4,438,757, the disclosure of which is incorporated herein by reference). The chlorinated polyisobutylene is reacted with an equimolar amount (or small excess) of a sodium salt of substituted thiadiazole (such as 2,5-dimercapto-1,3,4 thiadiazole) dissolved in water and stirred for several hours at elevated temperature (e.g. from about 50° to about 150° C.) The thiadiazole derivative can be recovered by dissolving the resulting reaction product in a suitable solvent followed by solvent stripping.

Other additives may be included in the fuel. Examples of such additives include antiknock agents (e.g. tetraethyl lead), other detergents or dispersants, demulsifiers, antioxidants, anticorrosives, and the like.

Although the mono alkyl substituted thiadiazole derivatives used herein will generally be added to a distillate fuel, they may be formulated as a concentrate using a hydrocarbon solvent, an alcohol solvent, or mixtures thereof, boiling in the range of about 150° to about 400° F. Preferably, an aromatic hydrocarbon solvent (such as benzene, toluene, xylene or higher boiling aromatics or aromatic thinners, and the like) is used. Aliphatic alcohols of about 3 to 8 carbons atoms (such as isopropanol, isobutylcarbinol, n-butanol, and the like), alone or in combination with hydrocarbon solvents, can also be used with the thiadiazole derivatives. The amount of the thiadiazole derivatives in the concentrate will ordinarily be at least about 10 wt. % and, generally, will not exceed about 70 wt. %. Similarly, at least about 10 wt. % solvent will be present in the concentrate. Generally, however, the amount of solvent will not exceed about 90 wt. %.

The distillate fuel compositions of this invention may also contain a small amount (typically from about 0.02 to about 0.5 wt. % and, preferably, from about 0.02 to about 0.15 wt. %) of a carrier fluid of low volatility. As used herein, the term "carrier fluid" is meant to include hydrocarbon and oxygenated species. Typically, the carrier fluid will have a kinematic viscosity of between about 5 to about 500 cSt at 100° C. Examples of such carrier fluids include lubricating oil base stocks, polyols, polyol esters, polyalkyleneoxides (e.g. Ucon® Fluids available from Union Carbide), their mixtures, and the like. Sometimes these carrier fluids demonstrate synergistic intake system detergency when used in combination with the mono alkyl substituted thiadiazole derivatives of this invention. This is particularly so with polyol esters (e.g. Hercolube® F which is available from Hercules).

The carrier fluid may also be present in the fuel concentrate. In general, at least about 10 wt. % of the carrier fluid may be present in the concentrate. Typically, the amount of carrier fluid will range from about 10 to about 80 wt. % of the concentrate.

This invention will be further understood by reference to the following Example which is not intended to reduce the scope of the claims appended hereto.

Example—Reduction of Intake Valve Deposits

Four 100 hour test runs were made on a standard mileage accumulation dynomometer using a 1987 BMW 325. In Test 1, an unleaded premium gasoline (93 RON) without any additives was tested. In Test 2, a blend of the same gasoline and 500 ppm of Hercolube F (carrier fluid) was tested. In Test 3, a blend of the same gasoline and 260 ppm of 2-mercapto, 5-polyisobutenyl thio-1,3,4 thiadiazole was tested. In Test 4, a blend of the same gasoline, 260 ppm of 2-mercapto, 5-polyisobutenyl thio-1,3,4 thiadiazole, and 500 ppm of Hercolube F was tested. Following each test, the intake valves were weighed and the weight obtained compared to the weight of the valves before the tests. The difference was the total valve deposit weight. The results obtained are shown in Table 1 below.

TABLE 1

| Test No. | Additive, ppm | Carrier Fluid, ppm | Average Deposit Weight, mg/valve |
|---|---|---|---|
| 1 | — | — | 150 |
| 2 | — | 500 | 152 |
| 3 | 260 | — | 41 |
| 4 | 260 | 500 | 6 |

The data in Table 1 show that the formation of intake valve deposits are significantly reduced when the fuel contains a mono alkyl substituted thiadiazole derivative. The data also show that further reductions in intake valve deposits are obtained when the fuel contains a mono alkyl substituted thiadiazole derivative and a carrier fluid. This is in marked contrast to when the carrier fluid is used alone.

What is claimed is:

1. A distillate fuel composition comprising
(a) a major amount of gasoline and
(b) a minor amount of a mono alkyl substituted derivative of a thiadiazole having the general structure

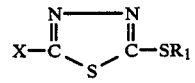

wherein $R_1$ is essentially a hydrocarbyl radical having a number average molecular weight between about 350 and about 5,000 and X is OH, $NH_2$, SH, or H.

2. The composition of claim 1 wherein $R_1$ is a polymer of olefins having from 2 to 6 carbon atoms.

3. The composition of claim 2 wherein $R_1$ is based on a polymer backbone of propylene, isobutylene, or mixtures thereof.

4. The composition of claim 3 wherein $R_1$ comprises a polymer backbone of isobutylene.

5. The composition of claim 1 wherein $R_1$ has a number average molecular weight of between about 500 and about 1500.

6. The composition of claim 1 wherein X is $NH_2$.

7. The composition of claim 1 wherein X is SH.

8. The composition of claim 1 wherein the mono alkyl substituted thiadiazole derivative is 2-mercapto, 5-polyisobutenyl thio-1,3,4 thiadiazole; 2-amino, 5-polyisobutenyl thio-1,3,4 thiadiazole; 2-mercapto, 5-polypropenyl thio-1,3,4 thiadiazole; 2-amino, 5-polypropenyl thio-1,3,4 thiadiazole; or mixtures thereof.

9. The composition of claim 8 wherein the mono alkyl substituted thiadiazole derivative comprises 2-mercapto, 5-polyisobutenyl thio-1,3,4 thiadiazole.

10. The composition of claim 1 which also contains from about 0.02 to about 0.5 wt. % of a carrier fluid having a kinematic viscosity of between about 5 and about 500 cSt at 100° C.

11. The composition of claim 10 wherein the carrier fluid comprises a polyol ester.

12. The composition of claim 1 wherein the amount of mono alkyl substituted thiadiazole ranges from about 40 to about 1000 ppm.

13. A method of reducing the formation of intake valve deposits in an internal combustion engine which comprises operating the engine using a fuel comprising (a) a major amount of gasoline and (b) a minor amount of a mono alkyl substituted derivative of a thiadiazole having the general structure

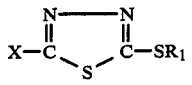

wherein $R_1$ is essentially a hydrocarbyl radical having a number average molecular weight between about 350 and about 5,000 and X is OH, $NH_2$, SH, or H.

14. The method of claim 13 wherein $R_1$ is a polymer of olefins having from 2 to 6 carbon atoms.

15. The method of claim 14 wherein $R_1$ is based on a polymer backbone of propylene, isobutylene, or mixtures thereof.

16. The method of claim 15 wherein $R_1$ comprises a polymer backbone of isobutylene.

17. The method of claim 13 wherein $R_1$, has a number average molecular weight of between about 500 and about 1500.

18. The method of claim 13 wherein X is $NH_2$.

19. The method of claim 13 wherein X is SH.

20. The method of claim 13 wherein the mono alkyl substituted thiadiazole derivative is 2-mercapto, 5-polyisobutenyl thio-1,3,4 thiadiazole; 2-amino, 5-polisobutenyl thio-1,3,4 thiadiazole; 2-mercapto, 5-polypropenyl thio-1,3,4 thiadiazole; 2-amino, 5-polypropenyl thio-1,3,4 thiadiazole; or mixtures thereof.

21. The method of claim 20 wherein the mono alkyl substituted thiadiazole derivative comprises 2-mercapto, 5-polyisobutenyl thio-1,3,4 thiadiazole.

22. The method of claim 13 which also contains from about 0.02 to about 0.5 wt. % of a carrier fluid having a kinematic viscosity of between about 5 and about 500 cSt at 100° C.

23. The method of claim 22 wherein the carrier fluid comprises a polyol ester.

24. A fuel concentrate comprising (a) from about 10 to about 70 wt. % of a mono alkyl substituted derivative of a thiadiazole having the general structure

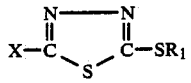

wherein $R_1$ is essentially hydrocarbyl radical having a number average molecular weight between about 350 and about 5000 and X is OH, $NH_2$, SH, or H, and (b) at least 10 wt. % of a hydrocarbon solvent, an alcohol solvent, or mixtures thereof boiling in the range of from about 150° to about 400° F.

25. The concentrate of claim 39 wherein the hydrocarbon solvent comprises an aromatic hydrocarbon solvent.

26. A gasoline composition comprising from about 40 to about 1000 ppm of a mono alkyl substituted thiadiazole derivative selected from the group consisting of 2-mercapto, 5-polyisobutenyl thio-1,3,4 thiadiazole; 2-amino, 5-polyisobutenyl thio-1,3,4 thiadiazole; 2-mercapto, 5-polypropenyl thio-1,3,4 thiadiazole; 2-amino, 5-polypropenyl thio-1,3,4 thiadiazole; and mixtures thereof.

27. The composition of claim 26 wherein the mono alkyl substituted thiadiazole derivative comprises 2mercapto, 5-polyisobutenyl thio-1,3,4 thiadiazole.

28. The composition of claim 27 which also contains from about 0.02 to about 0.5 wt. % of a carrier fluid having a kinematic viscosity of between about 5 and about 500 cSt at 100° C.

29. The composition of claim 28 wherein the carrier fluid comprises a polyol ester.

30. The composition of claim 29 wherein the amount of carrier fluid ranged from about 0.02 to about 0.15 wt. %.

31. The composition of claim 29 wherein the amount of mono alkyl substituted thiadiazole ranges from about 50 to about 500 ppm.

32. The composition of claim 24 wherein $R_1$ is a polymer of olefins having from 2 to 6 carbon atoms.

33. The composition of claim 34 wherein $R_1$ is based on a polymer backbone of propylene, isobutylene, or mixtures thereof.

34. The composition of claim 33 wherein $R_1$ comprises a polymer backbone of isobutylene.

35. The concentrate of claim 24 wherein $R_1$ has a number average molecular weight of between about 500 and about 1500.

36. The concentrate of claim 24 wherein the mono alkyl substituted thiadiazole derivative is 2-mercapto, 5-polyisobutenyl thio-1,3,4 thiadiazole; 2-amino, 5-polyisobutenyl thio-1,3,4 thiadiazole; 2-mercapto, 5-polypropenyl thio-1,3,4 thiadiazole; 2-amino, 5-polypropenyl thio-1,3,4 thiadiazole; or mixtures thereof.

37. The concentrate of claim 36 wherein the mono alkyl substituted thiadiazole derivative comprises 2-mercapto, 5-polyisobutenyl thio-1,3,4 thiadiazole.

38. The concentrate of claim 37 which also contains from about 10 to about 80 wt. % of a carrier fluid having a kinematic viscosity of between about 5 and about 500 cSt at 100° C.

39. The concentrate of claim 38 wherein the carrier fluid comprises a polyol ester.

* * * * *